United States Patent [19]

Coletti

[11] Patent Number: 4,679,799

[45] Date of Patent: Jul. 14, 1987

[54] APPARATUS AND METHOD FOR PROPELLING AN OBJECT

[76] Inventor: Don A. Coletti, P.O. Box 171, Troy, N.Y. 12182

[21] Appl. No.: 771,347

[22] Filed: Aug. 30, 1985

[51] Int. Cl.[4] ..... A63B 67/00

[52] U.S. Cl. ..... 273/318; 273/342; 273/412; 2/161 A; 272/67

[58] Field of Search ..... 273/318, 323, 324, 329, 273/330, 342, 412, 414; 272/67, 68; 128/1, 79; 2/19, 20, 159, 161 A

[56] References Cited

U.S. PATENT DOCUMENTS

| | | | |
|---|---|---|---|
| 1,156,047 | 10/1915 | Behrend | 273/324 |
| 2,011,362 | 8/1935 | Hayward | 272/67 |
| 2,541,392 | 2/1951 | Weiss | 273/324 |
| 3,342,491 | 9/1967 | Padovani | 273/324 |
| 3,467,381 | 9/1969 | Kreiss | 273/324 |
| 3,612,521 | 10/1971 | Wendeborn | 272/67 |

*Primary Examiner*—William H. Grieb

*Attorney, Agent, or Firm*—Schmeiser, Morelle & Watts

[57] ABSTRACT

A propulsion device having a base to be secured towards its periphery at at least three points to at least three fingers of a human hand. Whereby contracting the fingers toward each other forms a pocket in the base for receiving an object and the expansion of the fingers away from each other during the flexing of the hand moves the base to a taut position, whereby the object contained therein is propelled therefrom.

10 Claims, 3 Drawing Figures

APPARATUS AND METHOD FOR PROPELLING AN OBJECT

FIELD OF THE INVENTION

Generally, this invention relates to an apparatus for exerting a propulsive force on an object. More specifically, this invention relates to a device which is attached to a single human hand and is movable between a relaxed, pocket forming position and a taut propulsion imparting state.

BACKGROUND OF THE INVENTION

It is common in various sports and when playing certain games that a device is used to exert a propulsive force upon an object which in most situations is some type of ball. In fact, the common denominator of most sports or games may be said to be the use of some object to propel a ball to a desired location.

For example, the well known games of tennis or golf utilize a racket or club respectively in order to propel the game ball. In the game of jai alai, a long, hand-shaped basket is strapped to the wrist and used to catch and propel the game ball against a wall.

Similarly, there are a number of game type apparatuses which are used to both catch and eject the game ball. For example, the patent to G. Weiss, 2,541,392, discloses a cone which may be used to catch the game ball and a spring blade which may be snapped in order to then eject the ball from the cone. Other patents such as A. G. H. Kreiss, U.S. Pat. No. 3,467,381, and H. Behrend, U.S. Pat. No. 1,156,047, disclose similar devices.

Being familiar with such apparatus, it will be realized that it has heretofore been customary to produce either a device such as Weiss wherein the ball is caught and then ejected or else a racket type of device wherein the ball simply ricochets off of the apparatus. It has thus been necessary for the players to make a choice as to which type of device they will use, which device would then dictate to a large degree the mode and strategies of the game.

Furthermore, with present propulsion type devices, the device itself is generally inconvenient to transport. For example, most devices contain at least one elongated portion which is not flexible and, therefore, cannot be carried easily in one's pocket or the like.

It is therefore an object of this invention to provide a propulsion device which is easily transportable.

Another object of this invention is to provide a propulsion device which may be used not only to catch and then propel an object, but may also be used as a surface off of which an object may ricochet.

Another object of this invention is to provide a propulsion device which is economical to manufacture.

Still another object of this invention is to provide a propulsion device which is easy to use.

Objects and advantages of the invention are set forth in part herein and in part will be obvious herefrom, or may be learned by practice with the invention, the same being realized and attained by means of the instrumentalities and combinations pointed out in the appended claims.

SUMMARY OF THE INVENTION

It has been found that the objects of this invention may be realized by securing a flaccid base about its periphery to at least three fingers of a single human hand. Thus, the base spans the separation between the fingers. When the fingers are contracted, or moved close together, the base realizes its relaxed state and a pocket it formed in the base. When the hand is rapidly flexed open, the base quickly moves to its taut position, resulting in a propulsion of any object previously held in the pocket. Alternately, a user may maintain the base in its taut position and, thus, use the base as a support off of which an approaching object may be ricocheted.

The propulsion apparatus of this invention provides a remarkably versatile yet effective means for propeling an object such as a ball. Since the entire base is flaccid, the object may be easily folded for insertion into the user's pocket or similar place. In addition, since the fingers of a human hand are used as the support for the base, no other structure is needed. The ability to receive, propel, or ricochet an object is limited only by the strength and dexterity of the individual's hand. Consequently, the variety of ways in which the apparatus may be used are innumerable.

It will be understood that the foregoing general description, and the following detailed description as well are exemplary and explanatory of the invention but are not restrictive thereof. Thus, while the propulsion apparatus is particularly adapted for use with a game ball, the principles underlying the invention are not limited to such usage, but are equally applicable in any situation wherein an object needs to be received, propelled, or ricocheted. However, since the invention is particularly adapted to use with a game ball, reference is made herein to such usage as an example of a practical and useful embodiment.

The accompanying drawings, referred to herein and constituting a part hereof, illustrate embodiments of this invention, and together with the description serve to explain its principles.

DETAILED DESCRIPTION OF THE DRAWINGS

Figure 1:
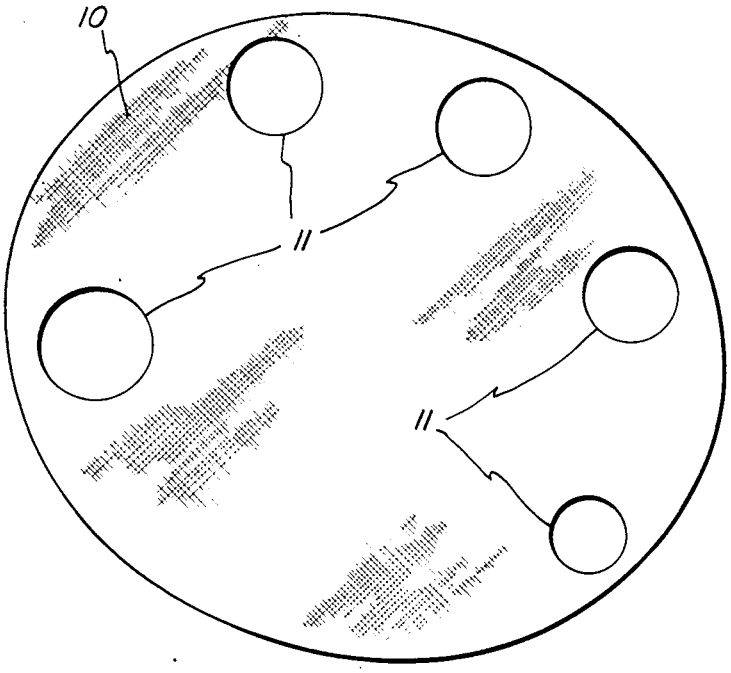
FIG. 1 is a planar view of the left hand image of the apparatus.
Figure 2:
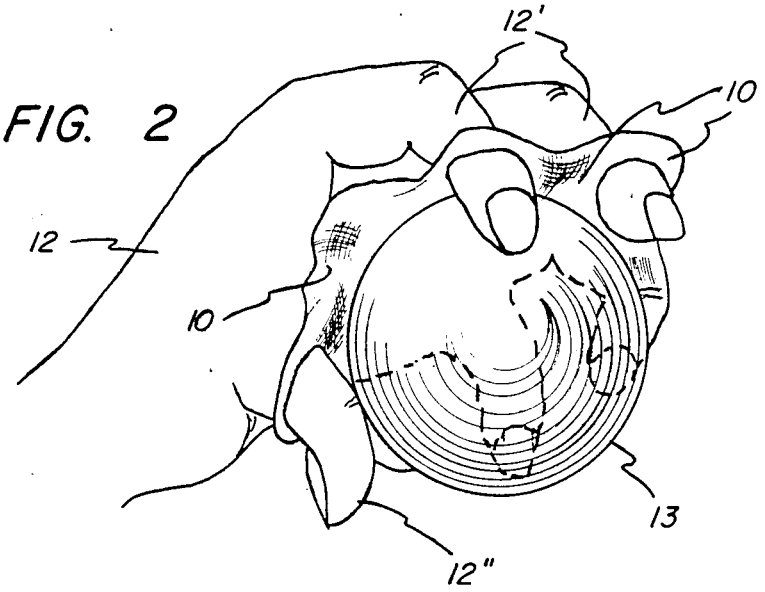
FIG. 2 is a view of a human hand wearing the apparatus and grasping a ball.
Figure 3:
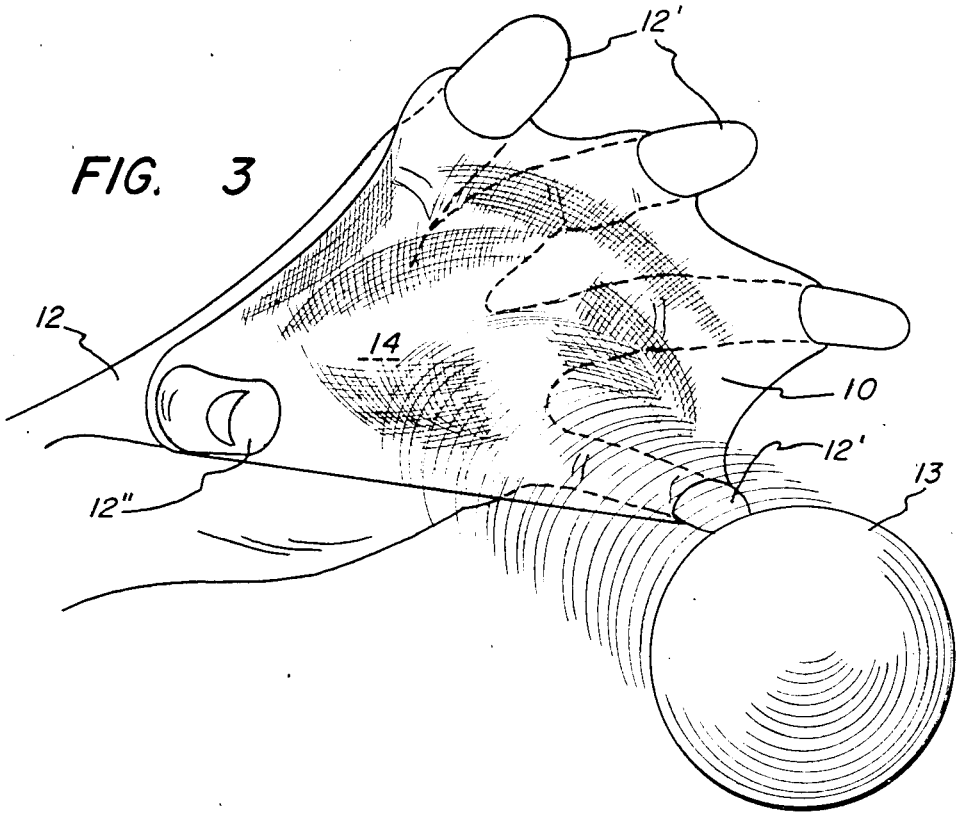
FIG. 3 is a view of the apparatus on a human hand and in its taut position with a ball being propelled therefrom.

Referring now more particularly to FIGS. 1 through 3 of the accompanying drawings, there is illustrated the propulsion apparatus and means for its employment. FIG. 1 depicts the typical propulsion device generally designated as 8. The propulsion device 8 has a base 10 which may be made of any one of a number of materials, but in the preferred embodiment may be defined as an essentially planar surface having finite bounds and comprising a homogeneous, solid surface composition such as a latex sheet or a woven lattice such as a netting composed of interstitial elastic cords. Though, of course, depending upon the type of play or response which is desired, various materials may be used.

Located in the base are a plurality of holes 11 into which the fingers of a single human hand may be inserted. While the drawings show five such holes in the preferred embodiment, it is conceivable that as few as three holes could be used. Similarly, other means for attaching the device to the fingers of a human hand could be employed. For example, the base 10 could be tethered in at least three places to the human hand and still provide essentially the same mode of operation.

FIG. 2 depicts the hand 12 wearing the device 8 and grasping a ball 13. Preferably, the fingers 12' are inserted into the holes 11 only up to the first knuckle, whereas the thumb 12" is inserted fully into its respective hole. Of course, such a wearing arrangement may be varied as desired by the individual player and also depending upon the way in which the device will be used.

As also shown in FIG. 2, when the fingers 12' and the thumb 12" are drawn toward each other, a pocket 15 is formed in the base. Depending upon the size of the ball being used in play, it is reasonable that in some situations the pocket could completely envelop the ball.

A similar arrangement is shown in FIG. 3, but where the base is being moved from its relaxed state to its taut state by the flexing of hand 12 with outstretched fingers 12' and thumb 12" .

In operation, the device 8 is placed upon a single human hand 12 by inserting the fingers 12' and thumb 12" into the appropriate holes 11 which are located toward the periphery of the base. While the base has certain finite bounds, and is of predetermined dimension, it is reasonable that various sizes could be produced in order to more accurately fit a particular individual's hand size. To start, the ball 13 may be placed within the pocket 15 of the base which is present only when the fingers 12' and thumb 12" are contracted toward one another and the base is in its relaxed state. Upon flexing the hand, the fingers along with the holes into which they are placed would be expanded, moving the base to its taut position which is substantially planar in configuration. Such movement would thus propel the ball 13 outwardly from the device. Alternately, it would be possible to simply hold the base in its taut position and simply swing one's arm so as to ricochet the ball 13 off of the base. Similarly, upon receipt of the ball, the user may either partially contract the hand so as to receive the ball into the pocket 15 or may hold the base in its taut position so as to ricochet the ball off of the base.

Although the subject invention discusses the use of the device 8 on only one hand, it is reasonable to assume that a user could use two such devices, one on each hand and thus provide greater variation to whatever game is being played.

Upon considering this invention, it should be clear that numerous variations could be made without departing from the basic concepts presented herein. For example, although previously various types of materials have been suggested for the use of the base 10, the main requirement is that the base be flaccid, or in other words, deformable as opposed to rigid, so as to provide variety in the options of play. Similarly, various means could be used to attach the base to a human hand without departing from the concept of having the base span the distance between the attachment points, and in its taut position be spaced apart from the palm 14 of the human hand. For example at least three sheaths could be secured to the periphery of the base such that each finger could be inserted into one of the sheaths.

Therefore, it is intended that the subject invention be limited only by the scope of the appended claims.

What is claimed:

1. A game apparatus comprising:

a flaccid, essentially planar base having finite bounds of predetermined dimension, within said bounds the surface of said base being homogeneous; and at least three attachment means, each attachment means located toward the periphery of the base a predetermined distance from each other, each of said attachment means being adapted to secure a portion of the base to a human finger, and support the base in a spaced apart relationship to the palm of the hand when the fingers are moved away from each other, whereby the contraction of the fingers and the associated attachment means toward each other move the base to a relaxed state wherein said base forms a pocket for holding an object, and the expansion of the fingers and associated attachment means away from each other, moves the base to its taut position wherein said base is substantially planar.

2. The invention of claim 1 wherein the attachment means further comprise openings in the base for insertion of human fingers.

3. The invention of claim 1 wherein each of the attachment means further comprises a sheath secured to the base and into which a human finger may be inserted.

4. The invention of claim 1 wherein the base is a latex sheet.

5. The invention of claim 4 wherein the base is elastic.

6. The invention of claim 1 wherein the base is a woven lattice.

7. The invention of claim 6 wherein the base is elastic.

8. The invention of claim 1 further comprising:

a ball of predetermined size sufficient to fit within the base pocket when the base is in its relaxed state.

9. A method for propelling an object comprising the following steps:

securing a base to at least three points about its periphery to at least three human fingers, whereby the base spans the area therebetween;

drawing the fingers toward one another so as to form a pocket within said base;

placing an object into the pocket; and flexing the hand so as to move the fingers away from each other and cause the base to be moved to a taut position thereby propelling the object outwardly therefrom.

10. A method of propelling an object comprising the following steps:

securing a base to at least three points toward its periphery to at least three human fingers, whereby the base spans the area there between;

flexing the hand so as to move the fingers away from each other moving the base to a taut position in a spaced apart relationship to the palm of the hand; and impacting an object upon the base so as to ricochet the object outwardly therefrom.

* * * * *